United States Patent [19]

Canevari

[11] 4,318,671

[45] Mar. 9, 1982

[54] EFFICIENCY SHIP PROPELLER

[75] Inventor: Gerard P. Canevari, Cranford, N.J.

[73] Assignee: Exxon Research & Engineering Co., Florham Park, N.J.

[21] Appl. No.: 570,872

[22] Filed: Aug. 8, 1966

Related U.S. Application Data

[63] Continuation-in-part of Ser. No. 494,698, Oct. 11, 1965, abandoned.

[51] Int. Cl.[3] ..... B64C 11/20; F01D 5/14

[52] U.S. Cl. ..... 416/90 A; 29/156.8 P; 114/67 A; 415/DIG. 1

[58] Field of Search ..... 170/135.4, 172; 114/67, 114/67.1; 416/90 A; 415/DIG. 1; 29/156.8 P

[56] References Cited

U.S. PATENT DOCUMENTS

| | | | |
|---|---|---|---|
| 3,196,823 | 7/1965 | Thurston | 114/67 A |
| 3,230,919 | 1/1966 | Crawford | 114/67 R |
| 3,290,883 | 12/1966 | Giles et al. | 415/DIG. 1 |

FOREIGN PATENT DOCUMENTS

| | | |
|---|---|---|
| 16122 | of 1884 | United Kingdom . |
| 3330 | of 1890 | United Kingdom . |
| 239 | of 1892 | United Kingdom . |

*Primary Examiner*—David H. Brown
*Attorney, Agent, or Firm*—Donald F. Wohlers

[57] ABSTRACT

A method of raising the propulsion efficiency of a propeller by reducing viscous drag. Basically, a fluid polymer solution is injected along the leading edge of the power face of the propeller blade to form a boundry layer solution adjacent the power face, thereby suppressing turbulence. A propeller suitable for practicing the above method is also disclosed.

5 Claims, 3 Drawing Figures

Fig. 1.
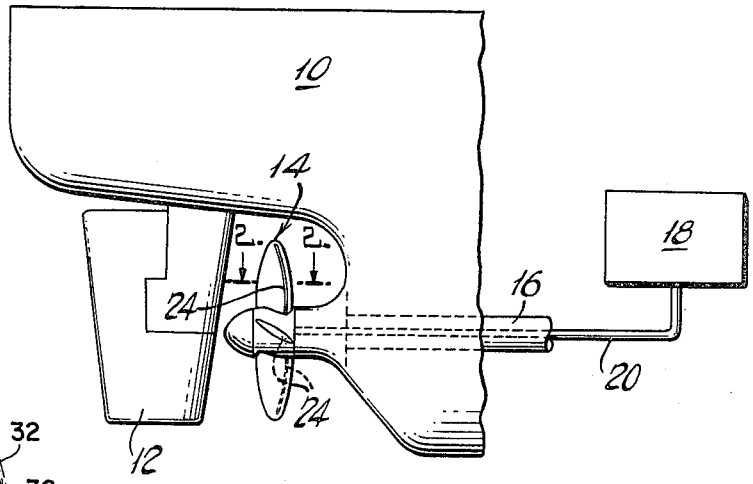
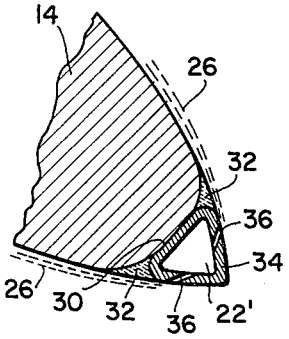
FIG. 3
Fig. 2.
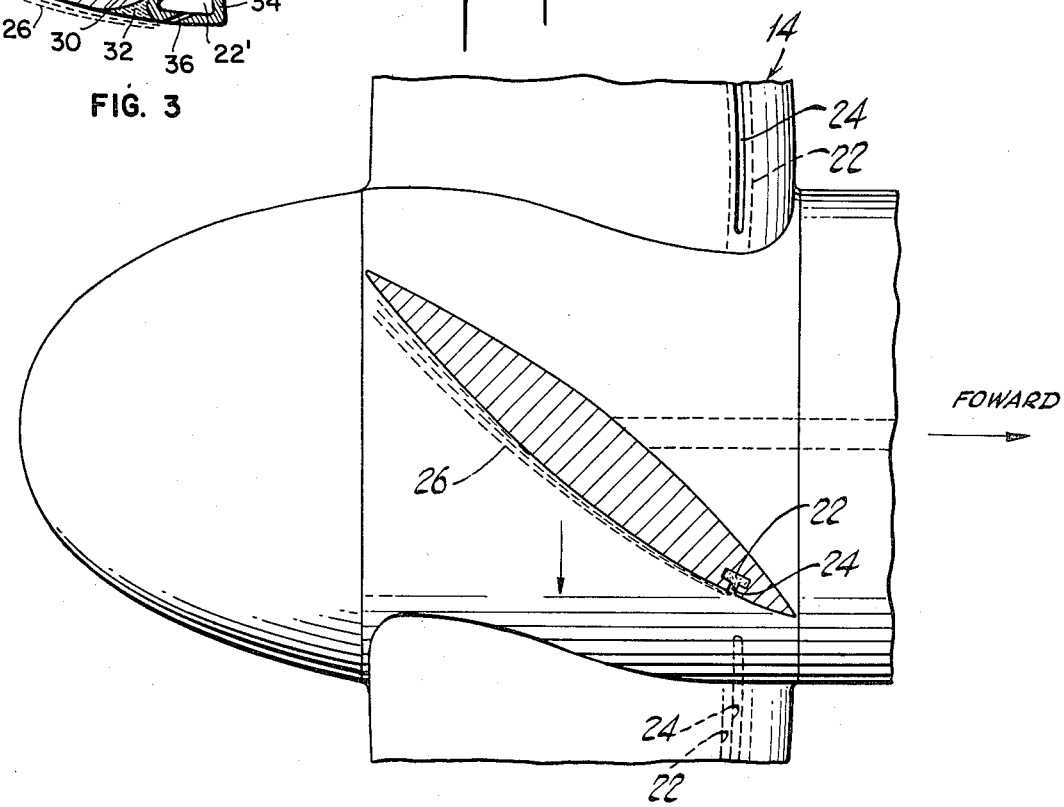

EFFICIENCY SHIP PROPELLER

This application is a Continuation-in-Part of Applicant's prior co-pending application, Ser. No. 494,698 filed Oct. 11, 1965, now abandoned.

The present invention relates to ship propellers in general and in particular to a novel means and method of increasing the efficiency of a propeller by introducing a viscoelastic polymer along the leading edge of the propeller blades to thereby suppress turbulent flow and maintain laminar flow thereover.

In conventional propellers, such as currently used by way of example in large oceangoing vessels, an efficiency of approximately 70% is realized. Of the 30% lost efficiency, 15% is approximately attributable to induced drag, while the remaining 15% is lost due to viscous or frictional drag. In accordance with the present invention, the loss due to the frictional or viscous drag of the propeller in the water is substantially reduced so that considerably improved overall propeller efficiency is obtained.

In fluid flow, the laminar flow regime is relatively more efficient (produces less frictional drag) than the turbulent flow regime. The transition from laminar to turbulent flow is caused by turbulent vortices that are "triggered" by dirt, surface roughness, etc. These turbulent vortices have a frequency and a magnitude of energy and are greater at higher Reynolds numbers and, as is well known, turbulence occurs as we increase Reynolds number. In typical propellers operating in ships in service, the Reynolds number is ordinarily of sufficient magnitude so that turbulent flow occurs about the propeller services and therefore a certain degree of energy is expended. In accordance with the present invention, a small addition of a viscoelastic polymer is introduced into the critical area of the blades of the propeller to suppress the onset of turbulence to thereby maintain laminar flow adjacent the propeller blades. In this way, because the regime of turbulence is avoided, a substantially reduced frictional or viscous drag is experienced on the propeller and a corresponding improved efficiency thereof is realized. In a sense, the viscoelastic nature of the polymer molecule permits it to act as a spring. The ability of the polymer molecule to dampen the onset of turbulent flow is, therefore, related to its "springiness" or elasticity which can, in turn, be related to its molecular structure. Accordingly, the present invention is particularly directed to the enhanced fluid flow condition which is realized in the boundary layer of the water immediately surrounding a ship's propeller blades by the introduction into the water of a small quantity of viscoelastic polymer which is preferably of a high molecular weight. A polymer substance of this category that has been employed to advantage is polyoxyethylene, known commercially as POLYOX. While this particular viscoelastic polymer substance has been employed to advantage, other similar substances may readily be used such as polyacrylamide or other linear polymers having a high molecular weight greater than one-half million which exhibit a relatively high "springiness" or large relaxation time.

In accordance with the invention, a passageway means is formed interiorly of each propeller blade along a leading edge portion thereof. The passageway means communicates with the surface of the leading edge along the power or rearward face of each propeller blade so that a viscoelastic polymer may be introduced into the surrounding water in the region where turbulent flow would normally tend to occur. The introduction of the polymer in this area of the propeller blade in the proportion of 0.1 to approximately 100 parts per million (ppm) has been found to be of sufficient concentration to suppress the occurrence of turbulent flow and to ensure the maintenance of laminar flow in the region immediately rearward of the point of introduction of the polymer. The invention as envisioned includes suitable passageway means internally within the propeller structure and supporting shaft so that a continuous supply of polymer, either diluted or in concentrated form, may be directed to the orifice means in the propeller blades. In one form of the invention, the polymer solution is introduced in a diluted state from a reservoir in the interior of the ship through the propeller shaft and propeller blades into the surrounding sea water so that in combination with the volume of the sea water in the boundary layer of the propeller blade, the desired range of 0.1 to 100 ppm is obtained. However, it should be realized that the polymer could just as readily be introduced in a highly concentrated state at a slower rate of introduction to accomplish the same order of magnitude of concentration in the propeller blade boundary layer. In either instance, the improved efficiency would be obtained.

Accordingly, it is a principal object of the invention to provide a novel improved efficiency ship propeller having a substantially reduced level of viscous or frictional drag.

Another object of the invention is to provide an improved method and apparatus for raising the efficiency of a ship propulsion system by the introduction of a viscoelastic polymer into the boundary layer of a propeller blade to thereby suppress the formation of turbulent flow thereabout.

Another object of the present invention is to provide a novel method and means for introducing a viscoelastic polymer into the boundary layer adjacent the faces of a propeller blade in the concentration of 0.1 to 100 ppm to thereby lower the frictional drag of the propeller blade in the boundary layer.

These and other objects and advantages of the invention will become apparent and the invention will be fully understood from the following description and drawings in which:

FIG. 1 is a fragmentary elevational view of a typical stern portion of a seagoing vessel employing the present invention;

FIG. 2 is a cross-sectional view taken along line 2—2 of FIG. 1 looking in the direction of the arrows; and FIG. 3 is an enlarged cross-sectional view of a propeller blade leading edge in accordance with another embodiment of the invention.

Referring to the drawings in particular, the invention as embodied includes a representative stern portion of a ship's hull 10 having a conventional rudder 12. A propeller 14 is mounted in conventional fashion upon a drive shaft 16. As shown, the propeller 14 includes a plurality of blades each of which have a channel or passageway means 22 formed interiorly along the leading edge of each blade (see FIG. 2). The passageway means 22 of each blade communicate internally with a conduit 20 extending through the drive shaft 16. The conduit 20 is connected to a viscoelastic polymer supply means shown schematically as 18. It will be understood that the polymer supply means 18 may include conventional metering and pumping means as required to supply the polymer contained therein in the required amounts to the propeller blades as hereafter set forth.

Each of the passageway means 22 extending along the leading edge of the propeller blades communicates with a leading edge surface portion of the blade so that the polymer fed to the passageway may exit into the boundary layer on the rearward or power face of each of the blades. As shown best in FIG. 2, a slotted orifice or outlet slit 24 communicates from the blade surface along substantially the entire leading edge thereof with the passageway means 22. In operation under normal cruising conditions of the vessel, the viscoelastic polymer supply means 18 is effective to deliver a metered and relative minute quantity of preferably high molecular weight viscoelastic polymer such as polyoxyethylene known commerically as POLYOX through the conduit means 20, passageway means 22 and outlet orifices 24 into the power face boundary layer generally designated 26. As shown, this boundary layer 26 remains in a laminar flow condition due to the fact that formation of turbulent flow is suppressed by the addition of the aforementioned viscoelastic polymer. Concentrations of polymer in the boundary layer fluid need only be in order of 0.1 to 100 ppm to suppress the formation of turbulent flow. While a highly concentrated or pure polymer solution could be stored in the supply means 18 and metered in minute quantities through the conduit 20 to form the desired range of concentrations of polymer within the boundary layer of fluid of 0.1 to 100 ppm, it is preferable to dilute the polymer solution with water or other suitable and stabilizing solutions in the container means 18 in a lower concentration so that it may be supplied in greater volumes through the passageway means 22 and orifices 24 to produce nevertheless the same net desired concentration in the boundary layer of 0.1 to 100 ppm.

The importance of the role of the condition of fluid flow in the boundary layer 26 with respect to the efficiency of the propeller can be readily understood. The boundary layer is, more or less, a zone of significant energy dissipation due to the shearing action between the mass of the bulk of the liquid surrounding the propeller and the solid blade surfaces thereof. The invention by the introduction of the small amount of high molecular weight polymer as disclosed into this small region of finite thickness where shearing of the liquid occurs between the propeller power face and the sea water minimizes disturbances in this zone that might "spawn or trigger" turbulence in the boundary layer thereby suppressing the formation of the turbulent vortices and maintaining laminar flow. In this laminar flow condition, a substantially reduced amount of energy is dissipated in the shearing operation in comparison with the energy that would be dissipated in shearing the boundary layer at the same rate under turbulent conditions.

Referring to FIG. 3 another embodiment of the invention is shown wherein the polymer is introduced into the boundary layer on both sides of each blade. Specifically, in this embodiment a pair of interrupted and obliquely inclined outlet slits 36, communicating with passageway means 22, are effective to introduce the polymer into the boundary layer 26 on the forward or suction face of the propeller, as well as on the rear or power face. In this way, optimum blade efficiency will be obtainable. The arrangement of FIG. 3 is particularly expedient for adaptation to propellers on existing ships wherein a blunted forward edge portion 30 is usually present or may be readily provided. Thereafter, a length of tubing 34 of suitably shaped cross-section is secured by brazing 32 to the leading edge 30. As in the embodiment of FIGS. 1 and 2, it will be understood that the tubing passage 22' communicates with a suitable source of polymer supply upon the ship.

Model testing has shown that the arrangement of FIG. 3 produces a substantial reduction in propeller shaft torque to maintain a constant ship speed. In a 65,000 DWT tanker design, polymer injection at the rate of 30 pounds per day has been calculated to produce a shaft torque reduction of $6\frac{1}{2}$ percent. When shaft torque is maintained constant, the injection of polymer at the above flow rate has been found to produce a speed increase of 0.2 knots in the normal ship cruise speed.

While a specific embodiment of the invention has been shown and described in detail to illustrate the application of the inventive principles, it will be understood that the invention may be embodied otherwise without departing from such principles.

What is claimed is:

1. A ship propeller comprising, a plurality of blade means each having a leading edge portion and a rearward facing power face, passageway means extending along the leading edge portion of each blade, said passageway means being defined by a generally triangular cross-section length of tubing, one exterior surface of said triangular tubing being secured by brazing to a leading edge portion of said blade means, and rearwardly inclined orifice means in the other two surfaces of said triangular tubing placing said passageway means in communication with the rear power face and opposite face of each blade for permitting a viscoelastic polymer to be discharged therefrom to suppress formation of turbulent flow along said power face and opposite face.

2. The method of raising the propulsion efficiency of a propeller by reducing its viscous drag, said propeller having a plurality of blades each of which have a rearwardly facing power face comprising the step of injecting a minute quantity of polyoxyethylene fluid polymer solution along and from the leading edge of the power face of each propeller blade to form a boundary layer solution adjacent said power face having a polymer concentration of less than 100 ppm to suppress turbulence thereover.

3. The method of raising the propulsion efficiency of a propeller by reducing its viscous drag, said propeller having a plurality of blades comprising the step of injecting a minute quantity of diluted liquid polyoxyethylene polymer first solution along the leading edge on each side of each propeller blade to form a liquid boundary layer second solution adjacent each blade having a polymer concentration of less than 100 ppm to suppress the start of turbulent fluid flow thereover.

4. The method of adapting bladed propellers for increased propulsive efficiency comprising the steps of forming a mounting surface on the leading edge of each blade, securing a tubular passageway means upon said mounting surface, and pumping and controlling the flow of a minute quantity of liquid polyoxyethylene polymer into said passageway means and outwardly therefrom through apertures therein onto both sides of each blade in a rearward direction to form a liquid boundary layer solution adjacent each blade having a polymer concentration of less than 10 ppm to suppress the start of turbulent fluid flow thereover.

5. The method of adapting one or more blades of a bladed ship's propeller with a polymer injection passageway along a leading edge thereof comprising the steps of blunting the cross-sectional contour of the leading edge portion of said blade, brazing a first side of generally triangular cross-section length of tubing to the blunted leading edge of said blade to thereby restore the original cross-sectional contour, and forming a plurality of rearwardly inclined apertures in the second and third sides of said triangular tubing.

* * * * *